US006536075B1

(12) United States Patent
Bonnet et al.

(10) Patent No.: US 6,536,075 B1
(45) Date of Patent: Mar. 25, 2003

(54) WASTE RECUPERATING ELECTRICAL APPLIANCE WITH TUBULAR FILTER

(75) Inventors: Jacques Bonnet, Saint Germain en Laye (FR); Jose Saude, Habloville (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 09/647,299

(22) PCT Filed: Apr. 1, 1999

(86) PCT No.: PCT/FR99/00765

§ 371 (c)(1),
(2), (4) Date: Sep. 29, 2000

(87) PCT Pub. No.: WO99/51136

PCT Pub. Date: Oct. 14, 1999

(30) Foreign Application Priority Data

Apr. 2, 1998 (FR) ..... 98 04337

(51) Int. Cl.[7] ..... A47L 9/14
(52) U.S. Cl. ..... 15/347; 15/344; 15/352
(58) Field of Search ..... 15/344, 347, 350, 15/352, 398

(56) References Cited

U.S. PATENT DOCUMENTS

| | | | | | |
|---|---|---|---|---|---|
| 2,205,599 | A | | 6/1940 | Mitchell | |
| 2,286,421 | A | * | 6/1942 | Kahn | 134/16 |
| 2,355,322 | A | * | 8/1944 | Nuffer et al. | 15/335 |
| 2,473,066 | A | * | 6/1949 | Miller | 15/344 |
| 2,972,160 | A | | 2/1961 | Hahn | |
| 3,184,778 | A | * | 5/1965 | Lindberg et al. | 15/344 |
| 3,191,365 | A | | 6/1965 | Feeley | 55/369 |
| 3,477,087 | A | * | 11/1969 | Robinson | 15/344 |
| 3,695,006 | A | * | 10/1972 | Valbona et al. | 15/319 |
| 3,755,993 | A | | 9/1973 | Cote | 15/327.7 |
| 3,903,564 | A | | 9/1975 | Morinaga | |
| 4,074,458 | A | * | 2/1978 | Catlett | 15/344 |
| 4,175,352 | A | * | 11/1979 | Catlett | 15/342 |
| 4,185,355 | A | * | 1/1980 | Williams | 15/344 |
| 4,279,095 | A | * | 7/1981 | Aasen | 15/352 |
| 4,488,331 | A | | 12/1984 | Ward | 15/339 |
| 4,699,641 | A | * | 10/1987 | Barnes, Jr. | 15/352 |
| 4,967,443 | A | * | 11/1990 | Krasznai et al. | 15/347 |
| 4,972,541 | A | | 11/1990 | Smith, Jr. | 15/105 |
| 5,297,311 | A | * | 3/1994 | Puri | 15/347 |
| 5,432,976 | A | * | 7/1995 | Alazet | 15/344 |
| 5,537,711 | A | * | 7/1996 | Tseng | 15/344 |
| 5,904,160 | A | * | 5/1999 | Wright | 134/21 |

FOREIGN PATENT DOCUMENTS

| | | |
|---|---|---|
| EP | 0 605 280 | 7/1994 |
| FR | 1 268 970 | 6/1961 |
| FR | 2 713 076 | 6/1995 |
| GB | 1 030 256 | 5/1966 |

* cited by examiner

*Primary Examiner*—Theresa T. Snider
(74) *Attorney, Agent, or Firm*—Browdy and Neimark, P.L.L.C.

(57) ABSTRACT

A waste recuperating electrical apparatus (13) composed of a suction device that includes in particular an electric motor (20) and a suction turbine (22), a suction aperture **(16*a*), and a tubular filter (1) forming a waste receptacle. The apparatus (13) further has a housing (14) arranged between the suction aperture (16*a*) and the suction turbine (22) with both of which it communicates on either side through ducts (16*b*) and the tubular filter (1) is arranged in the housing (14) such that one of its end orifices (6) is sealed and the opposite end orifice (4) is directly connected to the suction nozzle duct (16*b*). The filter housing has elements maintaining (3) the filter spaced from the filter (1) housing (14)** inner wall so as to increase the volume around the duct enclosing the filter periphery in the suction turbine direction.

12 Claims, 6 Drawing Sheets

WASTE RECUPERATING ELECTRICAL APPLIANCE WITH TUBULAR FILTER

CROSS REFERENCE TO RELATED APPLICATION

The present application is the national stage under 35 U.S.C. 371 of PCT/FR99/00765, filed Apr. 1, 1999.

TECHNICAL FIELD

The present invention relates to the field of Waste Recuperating Household Electrical Appliances, comprising particularly a filtration device.

PRIOR ART

One frequently finds, in numerous household appliances of the electric vacuum cleaner type, a filtration means constituted by a bag made of a material which is or is not woven, having a filtration quality suitable for retaining the majority of dirt that is suctioned. There exist numerous disposable bags provided with devices for closing the dust bag before it is thrown into the trash, as illustrated, for example, by the document FR 2 713 076. However, regular replacement of the bag involves a cost that is not negligible as regards consumable products, which is not well understood by most users, who experience, moreover, difficulties in correctly identifying the bag corresponding to their vacuum cleaner from among the multitude of bags available. It thus appears desirable to be able to have a reusable bag. However, one of the major problems of these bags, which are called "permanent", resides in the necessity to empty them when they are full. This operation is often a nuisance because of the very form of the bag which requires a substantial introduction into the atmosphere of dirt which has initially been retained in the bag, particularly the finest dust particles.

The document U.S. Pat. No. 4,972,541 discloses a suctioning feather duster having a suction motor equipped with batteries, an upstream air inlet as well as a downstream dust reservoir, situated at the end of the path of the suction air. This cylindrical reservoir is situated in the handle of the feather duster, which has openings intended to expel the suction air. This air is preliminarily freed of dust and detritus with the aid of a filtering tube housed in the handle. A trap situated at the extremity of the handle permits the dust contained in the receptacle to be easily emptied, while offering even the possibility of easily removing the filter in order to clean it or to replace it.

However, a major drawback of this device is its positioning, downstream of the motor/turbine group. In effect, situated behind the motor, the dirt passes through the motor zone before being filtered, and can thus potentially damage the motor on this occasion. Of course, in this particular case, the suction dirt is fine dust. This device can thus not be adapted to a vacuum cleaner for the usual larger dirt particles.

SUMMARY OF THE INVENTION

One of the objects of the present invention is thus to overcome the drawbacks of the prior art by presenting a waste recuperating appliance of any type, such as a vacuum cleaner, the filtration device of which, constituting a dirt receptacle, can be emptied and/or exchanged easily, all while offering the possibility of constituting a permanent filter for the vacuum cleaning appliance.

Another object of the invention is to present a vacuum cleaner the filtration and dirt retention means of which is, in addition, of simple construction.

Another object of the invention aims to improve waste recuperating appliances of any type which are constituted only of a filter and a non-filtering dirt receptacle, being able to be emptied by a trap door.

The present invention is achieved with the aid of a waste recuperating electrical appliance, having a suction device composed particularly of a motor and a suction turbine, a suction mouthpiece, a tubular filter constituting a dirt receptacle, said appliance having a housing arranged between the suction mouthpiece and the suction turbine with which it is in communication at one side and the other by conduits and in that the tubular filter is arranged in the housing in such a manner that one of its end orifices is blocked and the orifice at the opposite extremity is directly connected to the conduit of the suction nozzle.

This arrangement permits dirt to not pass through the zone having the motor, all while offering a compartment for the dirt which is able to be emptied easily and the filter of which is easily removed for cleaning and replacement.

One of the principal characteristics of the dirt compartment is to dispose of means for maintaining a filter separated from the interior wall of the housing of said filter, in order to provide a free suction volume around the periphery of the filter. It is in effect important that the filter volume is not restricted to a planar filter, while taking advantage of all the peripheral filtration surface. This arrangement permits the volume of the suction conduit to be increased around the periphery of the filter, in the direction of the suction turbine.

In a first embodiment of the invention, the spacing means are fixed to the filter housing. They then form a guiding means for the installation of the filter. Moreover, this configuration permits an improvement in the material at the level of the filtering element, thus reducing its resale price.

According to a second embodiment of the invention, the spacing means are fixed to the filter. This offers the possibility of providing an internal wall of the housing which is smooth, thus easier to clean.

According to one of the preceding configurations, advantageously, the filter is provided with a pneumatic sealing joint, at least at one of its ends. In order to avoid possible leakage of dust or dirt in the compartment of the filter or to the exterior of the appliance, a first possibility consists in that the conduit coming from the suction nozzle has an external diameter substantially identical to the internal diameter of the tubular filter in such a manner as to be insertable with a light friction contact. However, for considerations of long term reliability, it has been found preferable to provide a sealing joint.

According to a particular configuration of the invention, the filter is provided with a rigid zone which is impermeable to air at each end. This configuration permits a better mechanical gripping of the filter as well as a sure and reproducible positioning in its housing, all while aiding the sealing of the device.

Advantageously, the filter has a rigid structure along its length. This arrangement is all the more advantageous if the filtering material is flexible, the rigid structure permitting a mechanical holding of the filter compatible with its placement in a confined housing.

According to an advantageous characteristic of the invention, the housing of the filter comprises a trap door capable of being opened towards the outside of the appliance and which, in the closed position, comes to block the orifice end of the tubular filter opposed to that in communication with the suction nozzle. By this configuration, instead of having to inconveniently disconnect the conduit of the suction nozzle at the level of the filter in order to empty the latter, it suffices to manipulate a simple trap door from the side opposite to the suction.

According to a particular configuration of the invention, the filter has a shutter situated close to its orifice connected to the suction nozzle and able to be retracted upon encountering an exterior object and returning to its initial blocking position when the interaction with the exterior object ceases. This arrangement is particularly desirable when the suction mouthpiece can be withdrawn from the waste recuperating compartment. It is in effect important, in the case under consideration, that this air inlet opening of the filtering tube be blocked in order to prevent an eventual escape of the dirt recovered through this opening. The shutter can be simply articulated and retracted when the motor is placed in operation, by the low pressure created, returning to its initial blocking position upon stoppage of the motor.

According to an advantageous arrangement of the invention, a sealing joint is disposed at the rear of the filter, said joint having a groove capable of cooperating, in view of its positioning and its maintenance, with at least one positioning bulge arranged in the interior part of the housing. Thus, the user is assured that the filter is correctly installed in its housing, which prevents the filter from being compressed too much against the air inlet face, while exerting, however, a slight pressure on its inlet face, which permits a reduction in the leakage of air at this level. The seal, at the level of the air inlet, can be assured by a joint which is fixed either to the filter or the filter compartment.

BRIEF DESCRIPTION OF THE DRAWINGS

A present invention will be better understood with the aid of the following description and the attached figures, given by way of non-limiting examples, among which.

BEST MANNER OF CARRYING OUT THE INVENTION

Figure 1:
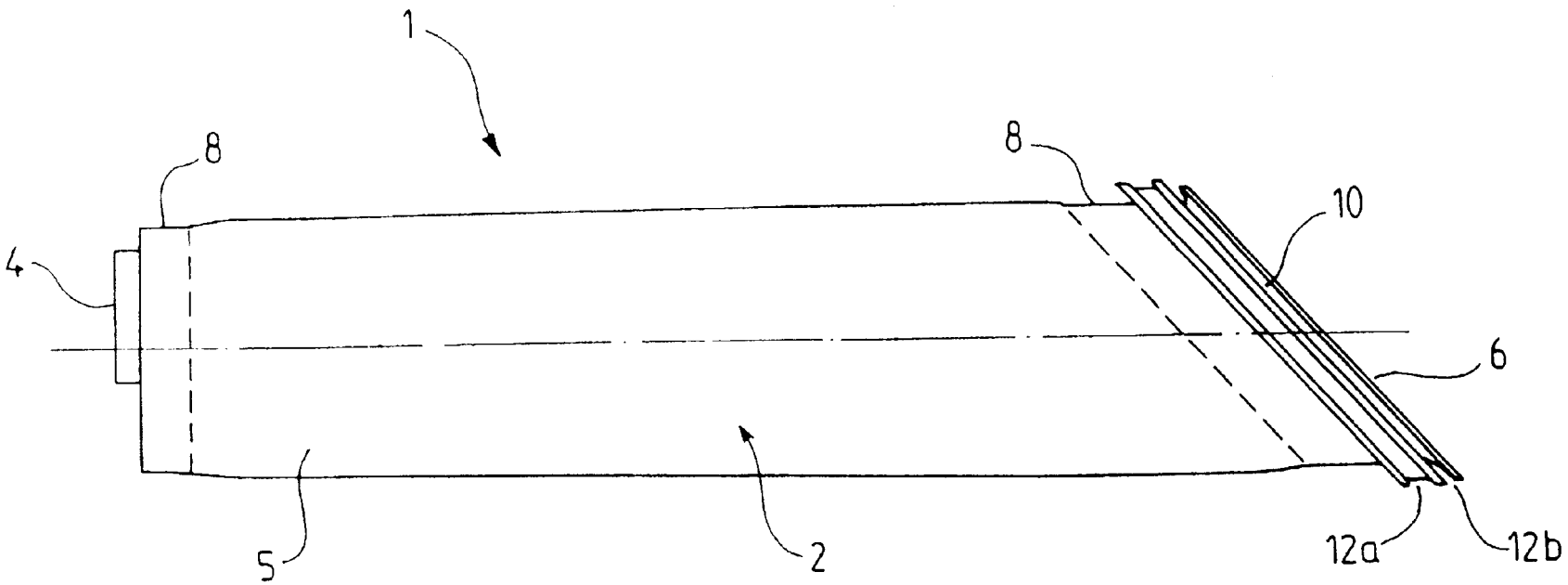
FIG. 1 presents a filter according to the present invention.
Figure 2A:
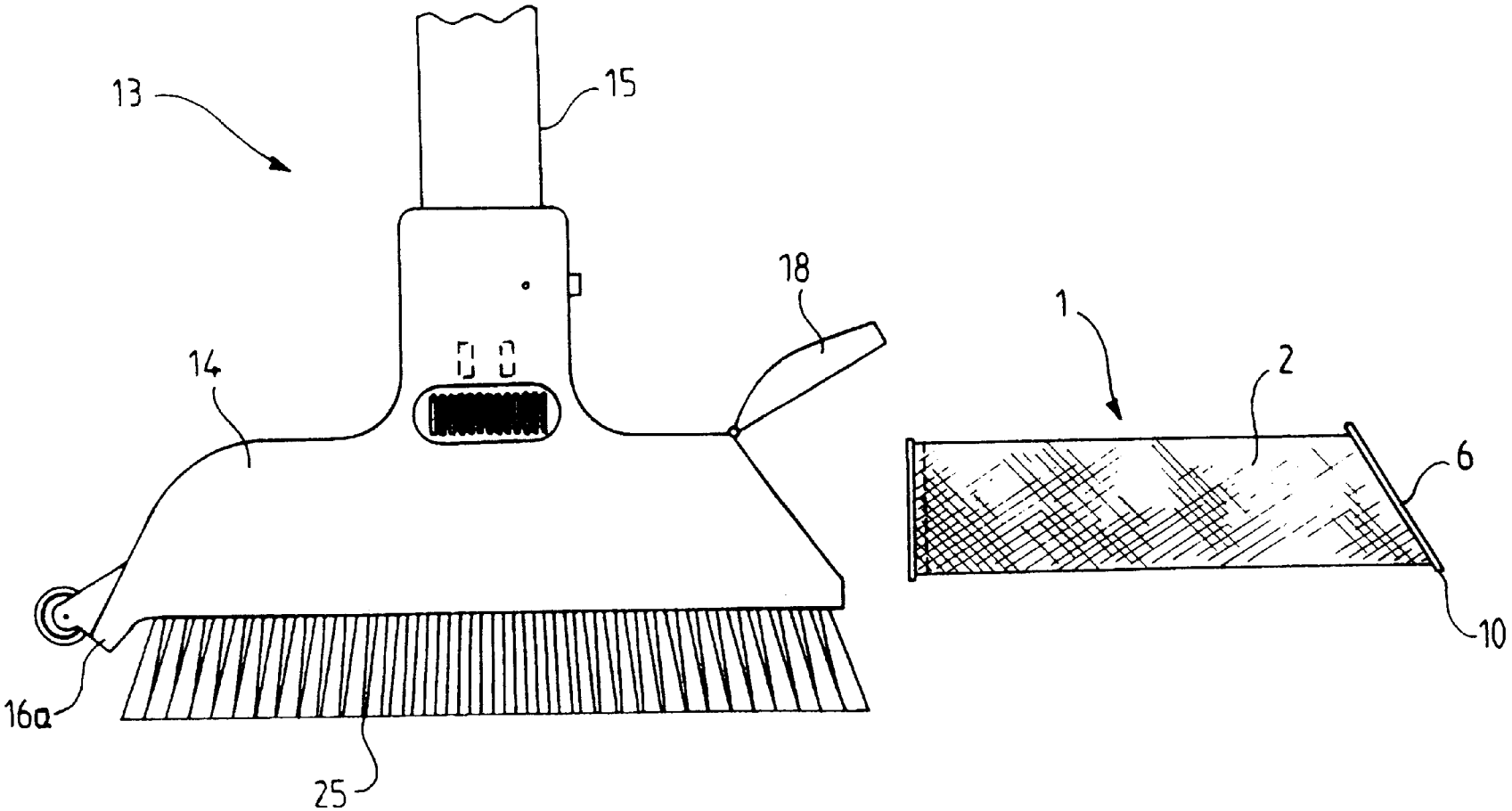
FIG. 2*a* is a schematic view of a waste recuperating assembly of the electric broom type.
Figure 2B:
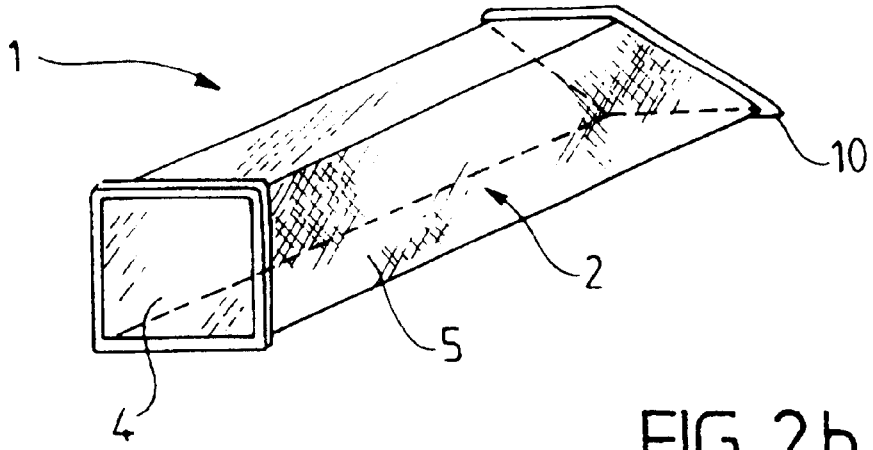
FIG. 2*b* is a perspective view of a filter utilized in a waste recuperating assembly of the electric broom type.
Figure 2C:
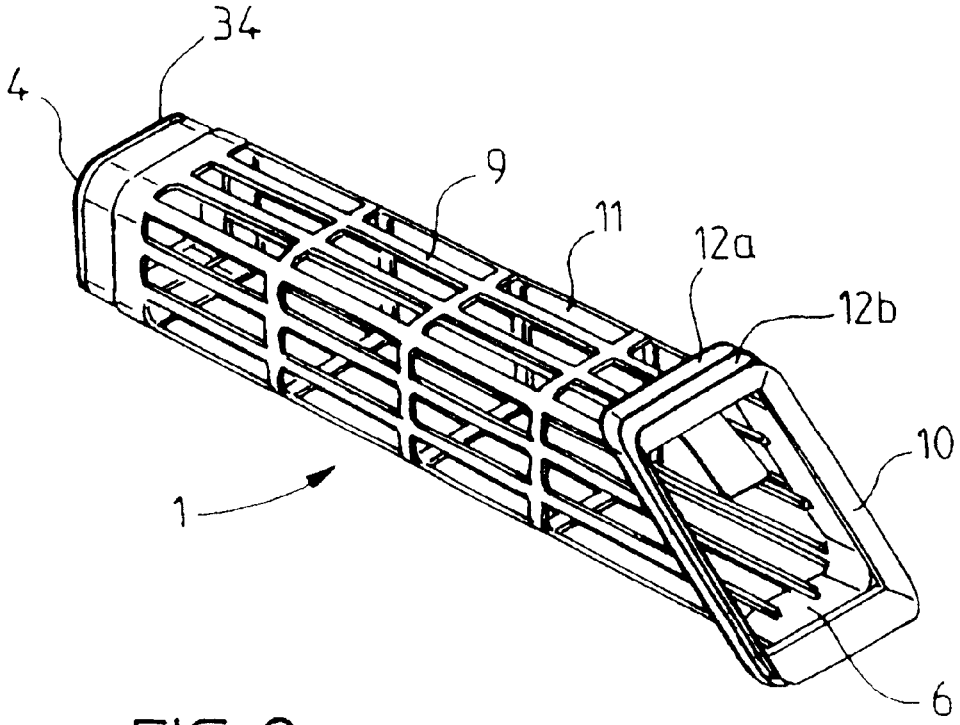
FIG. 2*c* is a perspective view of a structural variant of a filter utilized in a waste recuperating assembly.

FIGS. 1, 2*a*, and 2*b* present a tubular filter (1) utilized in the present invention. By the term tube, it is necessary to understand its general meaning, i.e., a hollow body, opened at two locations. In particular, this hollow body can be of elongated form, opened at its two ends, of circular cross-section, but also polygonal, elliptical . . . The filtering tube (1) thus has two open ends (4, 6) permitting, by the first (4) introduction of the waste material and entrained by the air flux into the tube where it is stored, and to be able, by the second (6), to empty the waste material when this is desired, when the motor of the waste recuperating appliance is halted.

The filtering tube (1) is composed of a filtering structure (2) which can be of any known type, of a material which is woven or not, assuring a consequent filtration of the suctioned waste material while offering a permeability to air which is compatible with the desired flow rates and the available power of the motor. The filtering tube (1) defines a storage volume (5) for the suction waste material. In an advantageous configuration, the filtering tube (1) has a rigid portion (8) at each end on which is fixed the filtering structure (2), constituting moreover a mechanical reinforcement. To these rigid portions can be added a sealing joint (10). This latter can however be disposed on the blocking part corresponding to the receptacle in which the filter (1) is housed.

In effect, as FIG. 2*a* indicates, according to a first configuration of the present invention, the filtering tube (1) is intended to be placed in a waste material receptacle of an appliance of the electric broom type (13). The configuration and the precise operation of this appliance are described particularly in the document EP 0 605 280. FIG. 2*a* broadly shows this appliance composed of a handle (15), of a hollow broom head (14) of a suction mouthpiece (16*a*) as well as bristles (25). A trap (18) permits the end (6) to be blocked during utilization of the appliance.

Advantageously, this trap door (18) can be opened towards the outside of the appliance. There can however be envisioned a double protection of the access to the dust, the trap door (18) only being accessible after having opened a first trap door towards the outside of the appliance. According to this configuration, the trap door (18) can be integrated with the filter or integrated with the case.

Figure 3:
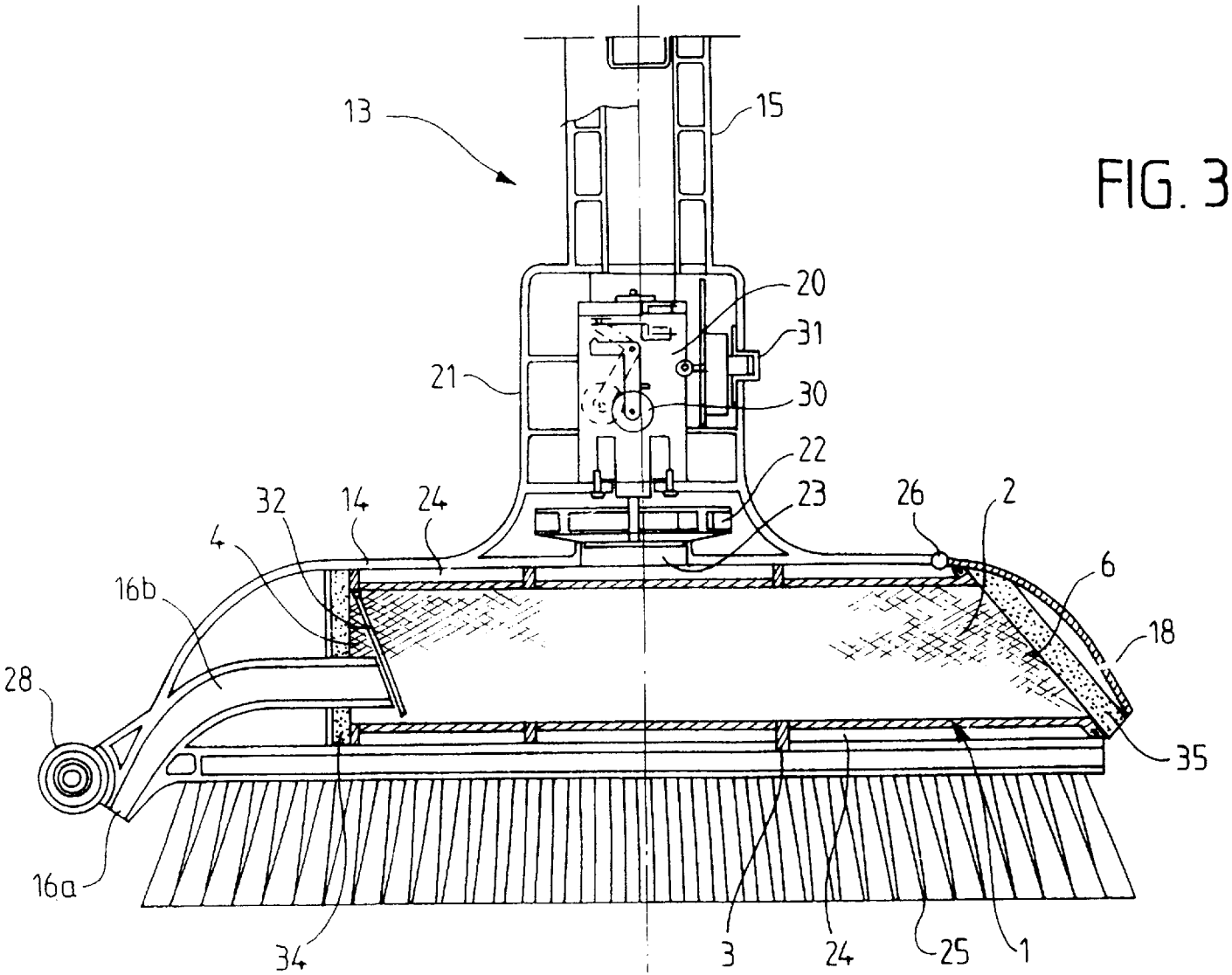
FIG. 3 is a longitudinal cross-sectional view of an electric broom equipped with a dust receptacle according to the present invention.

FIG. 3 details, in a longitudinal cross-sectional view, the structure of such an appliance equipped with the present invention, according to a first embodiment. This electric broom (13) comprises thus a handle (15), one of the ends of which has a compartment shielding a motor (20) and a turbine (22). A switch (31) permits the turning on of the motor which can be, moreover, supplied electrically by the intermediary of a gravity switch (30) when the broom is inclined. The head of the broom has a hollow part, housing (14) of the tubular filter (1), as well as a part provided with bristles (25). The suction conduit (16*b*) opens into the housing (14) of the suction head. A guide (28), being presented in the form of a roller, permits the suction mouthpiece (16*a*) to be maintained at an optimal distance from the floor, while permitting an easy displacement of the broom, without any effort being needed to maintain the broom at a given distance from the floor.

In a general manner, the filtering tube (1) is disposed in its housing (14) while being careful to arrange a space (24) around the periphery of the tube, thus increasing the volume of the suction conduit situated between the filter (1) and the turbine (22). Thus, positioning elements (3) permit the filtering tube to be maintained spaced from the walls of the receptacle (14). According to the first form of construction presented in FIG. 3, these positioning elements (3) are integrated with the filtering tube (1) in the form of radial protuberances.

This configuration thus permits air, entrained by the turbine (22), to be able to be suctioned, not exclusively by the conduit defined by the space (23) situated in proximity to the turbine, but also by the space (24), all around the filtering tube. This presents a clear advantage since the total effective filtration surface is thus increased, leading consequently to a decrease in the loss of pressure due to the filter and a less rapid clogging of this filter.

According to this first mode of filtration, a sealing zone (35) is associated with the waste trap door (18). This latter is articulated with the aid of a hinge (26). The trap door (18) is maintained closed by any known means, such as a snap connector, a locking mechanism, a clip . . . . The filtering tube (1) has a retractable shutter (32) at its inlet (4) which prevents waste material from exiting the filtering tube when the broom is inclined. The shutter, according to the example, opens under the force of the air flow, during suctioning. A second sealing zone (34) is present at the inlet of the tube. It provides a seal between the filtering tube and the suction mouthpiece **(16*a*). This sealing zone can either form a unit with the filter or, as in the example illustrated, a unit with the receptacle (14)**.

Figure 4:
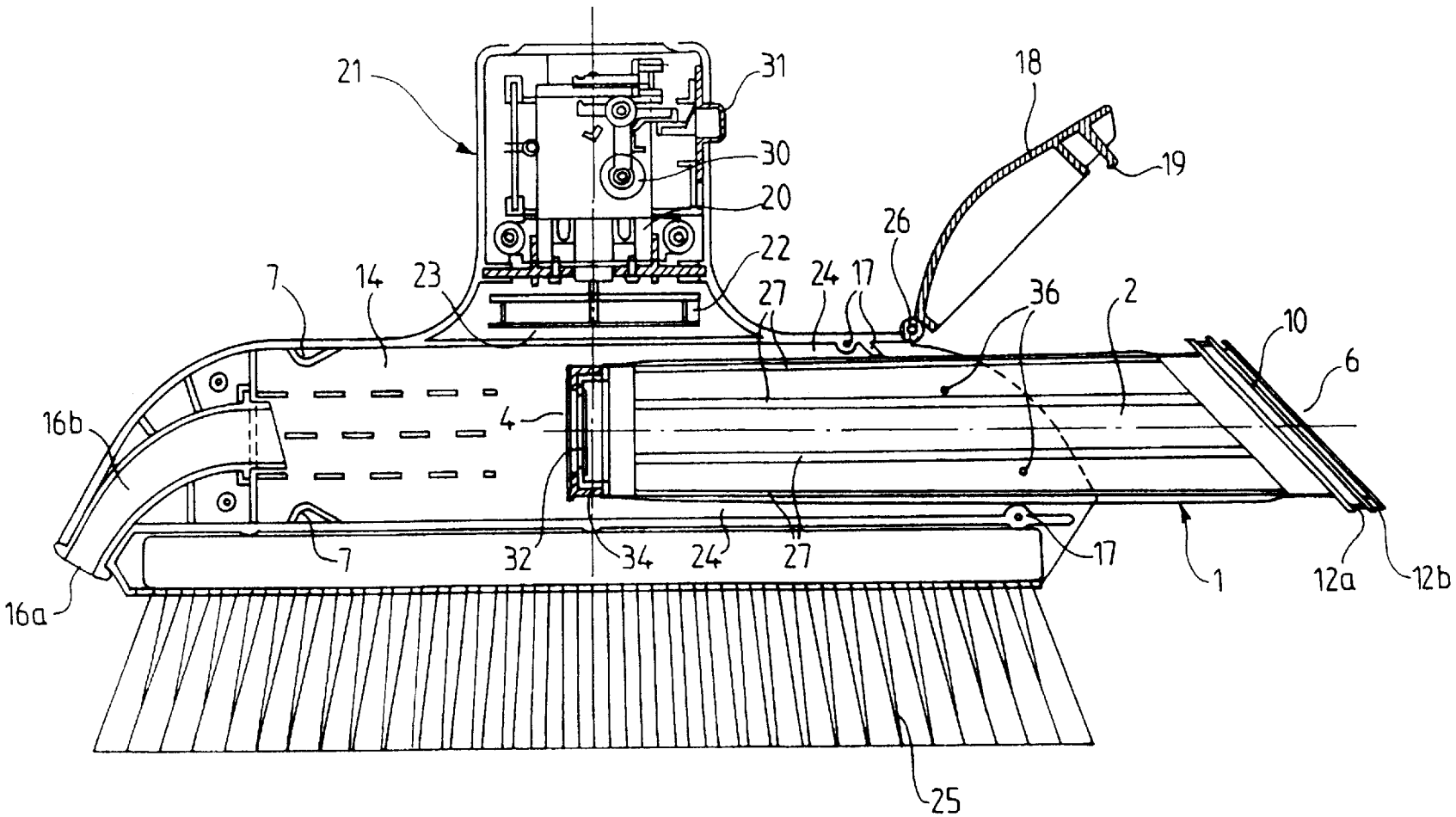
FIG. 4 is a view similar to that presented in the preceding figure, where the filter is partially introduced into its housing.

FIG. 4 shows, for the same appliance, another configuration of the present invention, the filtering tube (1) being shown partially introduced into its housing (14). The essential differences concern the positioning elements (7, 17) which are integrated to the receptacle (14) and are present in the form of ramps (7) situated toward the inlet orifice and in the form of protuberances (17) situated in proximity to the trap door (18). The ramps (7) permit an automatic guiding of the filter towards its optimal operation position, i.e., a position permitting space (24) to be arranged around the filtering tube (1) while correctly positioning the inlet (4) of the filter (1) opposite the conduit **(16*b*). In addition, the ramps (7) permit the filter (1)** to be retained while exerting a light pressure thereon.

The filter shown in FIG. 4 conforms generally to the filter presented in FIG. 1 but the trap door (18) is not provided with an element assuring a sealing of the device, this latter being assured by the joint (10). The trap door is provided with a lug (19) intended to maintain it in closed position. The filter (1) can be reinforced laterally by longitudinal elements (27), for example rigid bands connecting the rigid portions (8). The sealing zone (34) has the shutter (32) which is initially closed and which, under the effect of the low pressure created when the motor is placed in rotation, is lifted in order to allow passage of air. Use can be made, to achieve this function, of other known means such as a flexible annular joint having a central hole whose diameter is slightly less than the outlet diameter of the conduit **(16*b*), the deformation of this joint during its connection to the conduit (16*b*)** assuring the sealing function.

Advantageously, the compartment (14) is provided with two stop bosses (36), intended to correctly position the filtering tube (1) in its housing. Thus, the sealing joint (10) of the tube (1) has a first groove **(12*a*) the edges of which assure a sealing function, and a second groove (12*b*) capable of cooperating with the stop bosses (36) in order to indicate to the user that the filter need not be introduced further into its receptacle. During placement of the filtering tube (1), the cooperation between the bosses (36) and the groove (12*b*) as well as the pressure exerted by the ramps (7) on the body of the tube (1) assure maintenance of the filtering tube (1) in its housing (14)**.

FIG. **2*c* presents an extension of the concept of rigid longitudinal bands intended to reinforce the overall mechanical strength of the filtering tube (1), as described previously. In effect, this mechanical reinforcement is here present in the form of a completely separate rigid structure (9) of the cage type, which can be described as being a tube in which openings (11) are provided on its periphery. To the two ends (4, 6) of this structure can be fixed, by any known means, or by simple fittings, sealing joints (10, 34) as described previously. The filter, not shown in the figure, advantageously has a cross-section of a form analogous to the cross-section of the rigid structure (9), slightly smaller in area in a manner that it can be introduced to the interior of the structure (9) where it is maintained by any known means, while being sure to have a good seal at the level of the ends (4, 6), for example by a gluing process. This arrangement permits the development of filtering structures that are simple and thus inexpensive, while permitting high production rates for the rigid structures (9)** by plastic injection, for example.

Figure 5:
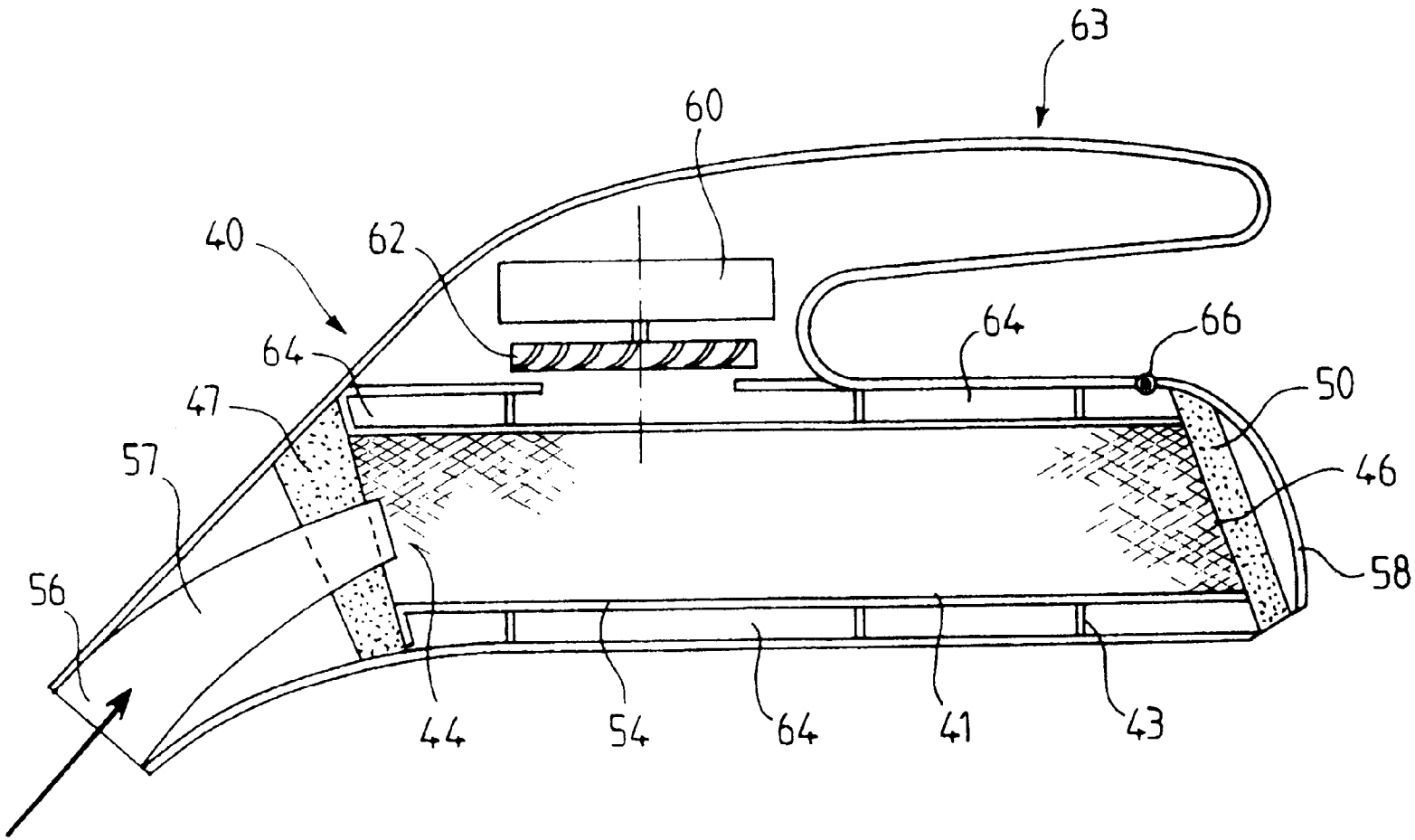
FIG. 5 schematically shows a hand vacuum cleaner having a waste receptacle according to the present invention.

In a second embodiment of the present invention, presented in FIG. 5, a hand vacuum cleaner (40), commonly called a "cleanette", is equipped with such a device for recuperating waste material. This hand vacuum cleaner can be connected by an electric cord to a power supply source or can be provided with batteries permitting a self-contained wireless operation. Thus, a filtering tube (41) is disposed at the interior of the compartment for recuperating waste materials and maintained at a distance from the walls of the receptacle by the positioning elements (43), thus providing a suction conduit (64) all around the filtering tube (41).

The suction mouthpiece (56) permits, in the direction of the arrow illustrated, suctioning of waste materials accumulated on the surface to be cleaned in the conduit (57) which opens, via its extremity opposite to the mouthpiece (56), into the internal volume of the filtering tube (41) through a sealing zone (47). There can be provided, when the suction conduit (57) can be retracted, a device similar to that presented in FIG. 3, where a pivoting shutter constitutes a movable obturator. In the rear zone, at the level of the end (46) of the tube, a trap door (58) is associated with a sealing joint (50). As for the variants illustrated previously, the sealing zones can be constituent elements of the receptacle (14) or integrated with the filtering tube (1).

The trap door (58) is pivoted with the aid of a hinge (66), in order to be able to empty the waste material contained in the filtering tube (41). The hand vacuum cleaner represented has, moreover, a motor (60) as well as a turbine (62). A handle (63) permits an easy gripping of this appliance. The filtering tube (1) can present simple lateral mechanical reinforcements or a more rigid structure like that presented in FIG. **2*c***.

The present invention is not limited to the two appliances presented. It is thus possible to dispose such a configuration for recuperation of waste materials in a vacuum cleaner of the cannister type, at the level of the guide handle of the tube connected to the suction nozzle, possibly with the aid of extension pieces, in a manner analogous to the disposition presented in FIG. 5 for a hand vacuum cleaner.

Thus, the user disposes of a waste material receptacle presenting numerous advantages. It remains clean because protected by a filter. This filter (1, 41) is conceived in such a manner as to be able to be emptied simply, by its tubular form. Thus, the user, when he desires to empty his waste material receptacle, opens the trap door (18, 58) over a trash can. The waste materials will then naturally fall into the trash can, the tubular form of the filter eliminating zones for retaining the waste materials. If needed, the filter can be withdrawn in order to be replaced. Moreover, clogging of the filtering tube is slowed by the presence of the spacing elements (3, 7, 17, 43) of the filter (1, 41) from the walls of the dust receptacle. By its geometric form, the fabrication of the filter is made easier, a filtering structure in planar form, for example, a porous medium or grid, being able to be easily flattened and fixed, for example by cementing or ultrasonic welding, on the rigid portions (8) and on the longitudinal rigidifying elements (27) of the tube, or even on the rigid structure (9).

Preferably, the filter structure is selected in such a manner that dust does not become attached thereto and it can be easily cleaned, This can be a grid of a synthetic material, for example Nylon or even PTFE, which retains only little waste material attached thereto and which can be easily cleaned.

The filtering tube (1, 41) in a variant of the device can be mechanically fixed at the level of the air inlet end (4, 44) by any known device, thus constituting a permanent filter. The device utilized can be removable or not, depending on the usage of the appliance.

POSSIBILITY OF INDUSTRIAL APPLICATION

The invention finds its application in the technical domain of devices intended for cleaning or lifting dust and small pieces of household dirt.

What is claimed is:

1. An electrical waste recovering appliance (13, 40), comprising a suction device composed of an electric motor (20, 60) and of a suction turbine (22, 62) a suction mouthpiece (16*a*, 56), a tubular filter (1, 41) constituting a waste material receptacle, a housing (14, 54) having an interior wall which encloses a space that is interposed between the suction mouthpiece (16*a*, 56) and the suction turbine (22, 62), a first conduit establishing communication between the suction mouthpiece and the space, and a second conduit establishing communication between the suction turbine and the space, wherein the tubular filter (1, 41) has first and second opposed end orifices that are both open to permit passage of waste, the tubular filter is held in the space in such a manner that the first end orifice allows waste to pass from the first conduit via the first end orifice into the tubular filter, and the appliance further comprises a blocking member that is movable relative to the housing between a closed position for blocking the second end orifice and an open position to permit waste to be removed from the tubular filter via the second end orifice.

2. The electrical waste recovering appliance according to claim 1, further comprising means (3, 7, 17, 43) for maintaining the tubular filter spaced from the interior wall of the housing.

3. The electrical waste recovering appliance according to claim 2, wherein the means (3, 7, 17, 43) for maintaining the tubular filter spaced from the interior wall of the housing are fixed to the housing (14, 54).

4. The electrical waste recovering appliance according to claim 2, wherein the means (3, 7, 17, 43) for maintaining the tubular filter spaced from the interior wall (14, 54) of the housing are fixed to the tubular filter (1, 41).

5. The electrical waste recovering appliance according to claim 1, wherein the tubular filter (1, 41) has at least one joint (10, 34, 35, 47, 50) providing a pneumatic seal at one of its orifices (4, 6, 44, 46).

6. The electrical waste recovering appliance according to claim 1, wherein the tubular filter (1, 41) has a rigid zone (8, 32) impermeable to air, at each orifices.

7. The electrical waste recovering appliance according to claim 1, wherein the tubular filter (1, 41) has a rigid mechanical reinforcing structure (9, 27) for mechanical reinforcement along its length.

8. The electrical waste recovering appliance according to claim 1, wherein the blocking member comprises a trap door (18, 58).

9. The electrical waste recovering appliance according to claim 8, wherein the trap door (18, 58) is fixed to the housing (14, 54) thus closing said housing, said trap door (18, 58) opening toward the outside of the housing.

10. The electrical waste recovering appliance according to claim 8, wherein the trap door (18, 58) is fixed to the tubular filter (1, 41).

11. The electrical waste recovering appliance according to claim 1, wherein the tubular filter (1, 41) has a shutter (32), situated at the first end orifice (4, 44) for initial blocking of the first end orifice (4, 44), capable of being retracted by contact with an exterior object or by the low pressure created by the rotation of the suction turbine (22, 62), and returning to its initial blocking position when the interaction with the exterior object ceases or when the turbine (22, 62) is stopped.

12. The electrical waste recovering appliance according to claim 1, further comprising a sealing joint (10, 35, 50) disposed adjacent the second orifice end of the tubular filter, said joint having a groove (12*b*) capable of cooperating, in view of its positioning and its maintenance, with at least one positioning bulge (36) arranged in an interior part of the housing (14, 54).

* * * * *